United States Patent [19]

Werding

[11] Patent Number: 4,650,094

[45] Date of Patent: Mar. 17, 1987

[54] THRUST REGULATOR HAVING TURBULENCE GENERATING MEANS FOR THRUST CONTROL

[76] Inventor: Winfried J. Werding, 77 Ave. General Guisan, CH-1099 Pully, Switzerland

[21] Appl. No.: 629,545

[22] PCT Filed: Nov. 8, 1983

[86] PCT No.: PCT/CH83/00122

§ 371 Date: Jul. 6, 1984

§ 102(e) Date: Jul. 6, 1984

[87] PCT Pub. No.: WO84/01930

PCT Pub. Date: May 24, 1984

[30] Foreign Application Priority Data

Nov. 10, 1982 [CH] Switzerland ..... 6534/82

[51] Int. Cl.[4] ..... B67D 5/34

[52] U.S. Cl. ..... 222/55; 222/61; 222/396; 137/504; 138/45; 239/497; 239/533.1; 239/572; 251/120

[58] Field of Search ..... 222/3, 4, 55, 61, 394, 222/396, 402.1, 464, 386.5, 547, 564; 137/504; 138/45, 46; 251/120; 239/492, 464, 533.1, 570, 572, 493, 494, 496, 497

[56] References Cited

U.S. PATENT DOCUMENTS

| | | | |
|---|---|---|---|
| 780,986 | 1/1905 | Francis | 137/504 |
| 2,921,747 | 1/1960 | Burman | 239/464 |
| 3,122,162 | 2/1964 | Sands | 137/504 X |
| 3,421,542 | 1/1969 | Adams et al. | 137/504 |
| 3,503,417 | 3/1970 | Toda et al. | 137/504 X |
| 3,785,571 | 1/1974 | Hoening | 239/492 |
| 3,863,673 | 2/1975 | Sitton | 251/120 X |
| 3,918,481 | 11/1975 | Doe et al. | 137/504 |
| 3,958,596 | 5/1976 | Garrard | 137/504 |
| 4,075,294 | 2/1978 | Saito et al. | 138/45 X |
| 4,082,225 | 4/1978 | Haynes | 239/533.1 X |
| 4,244,526 | 1/1981 | Arth | 138/46 X |
| 4,437,493 | 3/1984 | Okuda et al. | 137/504 X |
| 4,487,334 | 12/1984 | Werding | 222/396 X |

FOREIGN PATENT DOCUMENTS

| | | | |
|---|---|---|---|
| 240955 | 1/1960 | Australia | 137/504 |
| 1400733 | 2/1972 | Fed. Rep. of Germany . | |
| 60952 | 2/1955 | France | 138/46 |
| 421009 | 3/1967 | Switzerland . | |

*Primary Examiner*—Joseph J. Rolla
*Assistant Examiner*—Kevin P. Shaver
*Attorney, Agent, or Firm*—Wells & Wells

[57] ABSTRACT

A regulator having turbulence generating device for controlling thrust. A differential piston (2) is biased by a spring (3) located in a discharge channel (8*a*) of a medium under pressure. The spring (3) is weighted in such a way that it is compressed at a given pressure within the container so that the differential piston (2) takes a first end position and decreases the opening of the discharge channel (8*a*) to a minimum. The spring (3) expands proportionally to the pressure drop due to the discharge of the medium (18) from the container and shifts the piston (2) so that the opening of the discharge channel (8*a*) increases gradually until the piston (2) has reached a second end position as soon as a given minimum pressure has been reached in the container. The shape of the piston (2) in comparison to that of the discharge channel (8*a*) is chosen in such a way that through its displacement it guarantees that the sum of the multiplication of the pressure remaining in the container and the remaining opening of the discharge channel (8*a*) remains at least approximately constant. The discharge channel (8*a*) ends in a chamber (23) from which channels (24) radiate, each of which forms a tangent with the circumference of the chamber (23) and ends in an annular channel (19*a*) from which supply channels (21) of the spray nozzle (5) radiate. Thrust control takes place initially by the turbulence provided by the channels and later by the weighted spring (3).

14 Claims, 7 Drawing Figures

BEST AVAILABLE COPY

THRUST REGULATOR HAVING TURBULENCE GENERATING MEANS FOR THRUST CONTROL

BACKGROUND OF THE INVENTION

The present invention relates to a thrust regulator for use with a container having gas under pressure. This thrust results from the pressure which acts upon the surface of a medium in the interior of a container, for instance an aerosol can, in order to keep the flow of this medium per unit time approximately constant during the ejection of this medium from the container. This is in spite of a pressure drop proportional to the amount of the ejected medium, when the pressure is generated by a pressure gas such as air or nitrogen.

Many countries prohibit the use of FREON-type chlorofluorocarbons as propellants in order to contribute to the protection of the ozonosphere shielding our planet against excessive ultra-violet radiation.

Since this prohibition went into effect, mixtures of propane and butane or dimethyl ether have been increasingly used as propellants.

Just as FREON is detrimental to the environment, propanebutane mixtures and dimethyl ether are dangerous because they constitute an explosive hazard.

The use of $CO_2$, $N_2$, $N_2O$ or simply compressure air are tried as propellants. Their use, however, has the disadvantage that during ejection of the product from the container a pressure drop occurs due to the increasingly large volume that remains in the container and which is proportional to this increase in volume. Therefore, the pressure drop causes a decrease of the amount ejected per unit time and when the product is being sprayed the size of the droplets increases at the same time which means that the spray becomes too wet and hence unusable. Moreover the use of $CO_2$ and $N_2$ O must be avoided, because these gases are partly absorbed by the product to be sprayed and are therefore ejected with the product, which causes a residual flow in the form of drops after the closure of the valve. This problem can partly be solved by the use of a spary nozzle which the inventor of the present invention describes in his U.S. Pat. No. 4,260,110, and which allows an atomization of products at low mechanical pressure, that is to say without any known propellant gas. These products, through their force of expansion when coming into contact with the air pressure, atomize the droplets as soon as they are released from the nozzle. In the case of this spray nozzle it is only the mechanical breakup which guarantees a satisfactory atomization at a mechanical pressure below 2 bar.

When, however, this spray nozzle is used with aerosol cans using compressed gases as propellants, there occurs a high flow rate per unit time during fine atomization. When the can is filled completely and under high pressure there occurs a low flow rate per unit time during atomization which is still fine when the pressure decreases due to the discharge of the product.

In order to solve this problem of variable flow rates depending on the pressure drop within the can, the present inventor proposes in his European Patent Application No. 81902294.8, "Schubregler zur Verwendung im Inneren von unter Gasdruck stehenden Behältern", a thrust regulator by means of which the released amount of the medium per unit time being expelled from the container is at least approximately held constant despite the pressure drop becoming effective in the interior of the container. In a discharge channel there is a differential piston, the size of which is provided in such a ratio to the discharge channel that a minimum opening for the escape of the medium is retained during the whole ejection phase. The differential piston has different dimensions at the ends of the surfaces, the larger surface being located opposite to the flow of the medium. The differential piston rests upon a spring which is adjusted in such a way that it is compressed at a certain pressure within the container so that the differential piston takes a first end position, through which it decreases the size of the opening area of the discharge channel to a minimum, and that the spring loses tension proportionally to the pressure drop due to the discharge of the medium from the container and thus shifts the differential piston in such a way that the opening of the discharge channel increases gradually until the piston has reached a second end position as soon as a certain minimum pressure has been reached in the container. The shape of the piston in comparison to that of the discharge channel is chosen in such a way that an at least approximately constant sum of the multiplied pressures in the container is guaranteed through the remaining opening.

Each of the embodiments proposed in European Patent Application No. 81902994.8 has shortcomings and disadvantages such as: too high a permeability to steam pressure of the membranes; too high a price for the injected parts made of synthetic materials due to the pressure required; jerky regulation; and consequently jerky atomization due to an axial to-and-fro movement of the differential piston.

SUMMARY OF THE INVENTION

The object of the present invention is a regulator which, together with the spray nozzle such as described in the above mentioned U.S. Pat. No. 4,260,110, achieves a constant flow rate per unit time despite the pressure drop in an aerosol container having a compressed gas as a propellant such as nitrogen and allows air to penetrate into the can as the latter is emptied of its contents.

According to the invention this object is achieved by a regulator which has turbulence generating means for controlling thrust.

The thrust regulator consists of a differential piston (2) which rests upon a pressure spring (3) located in the interior of a discharge channel (8*a*) of a medium (18). The medium is under pressure in the interior of a container.

The differential piston (2) is of such a size compared to that of the discharge channel (8*a*) that a minimum opening for the discharge of the medium (18) remains during the entire ejection process. The differential piston (2) has ends (12, 14) with surfaces of different dimensions. The largest surface (14) is adjacent the flow of the medium (18).

A spring (3) is weighted in such a way that it is compressed at a given pressure within the container so that the differential piston (2) takes a first end position and decreases the opening of the discharge channel (8*a*) to a minimum. The spring (3) expands proportionally to the pressure drop due to the discharge of the medium (18) from the container and shifts the piston (2) so that the opening of the discharge channel (8*a*) increases gradually until the piston (2) has reached a second end position as soon as a given minimum pressure has been reached in the container.

BEST AVAILABLE COPY

The shape of the piston (2) in comparison to that of the discharge channel (8a) is chosen so that through its displacement it guarantees that the sum of the multiplication of the pressure remaining in the container and the remaining opening of the discharge channel (8a) remains at least approximately constant.

The discharge channel (8a) ends in a chamber (23) from which channels (24) radiate, each of which forms a tangent with the circumference of the chamber (23) and ends in an annular channel (19a) from which supply channels (21) of the spray nozzle (5) radiate. The tangential channels (24) of the chamber (23) form a right angle to the discharge channel (8a) and a right angle to the supply channels (21) of the spray nozzle (5).

The front side of the lower end (12) of the piston (2) rests firmly upon the upper side of a core (4) at the highest pressure in the container. The openings between the piston (2) and the inner wall of the discharge channel (82) narrows down continuously in a downward direction. The spring (3) has a strength which is chosen so as to compress the spring (3) at a given pressure which is exerted upon the surface of the medium (18) so that the differential piston (2) is allowed to rest firmly upon the upper side of the core (4).

BRIEF DESCRIPTION OF THE DRAWINGS

The details of the present invention are shown in the following description of the preferred embodiments, not to be taken in a limiting sense, however, and are illustrated in the following drawings in which.

DESCRIPTION OF THE PREFERRED EMBODIMENTS

Figure 1:
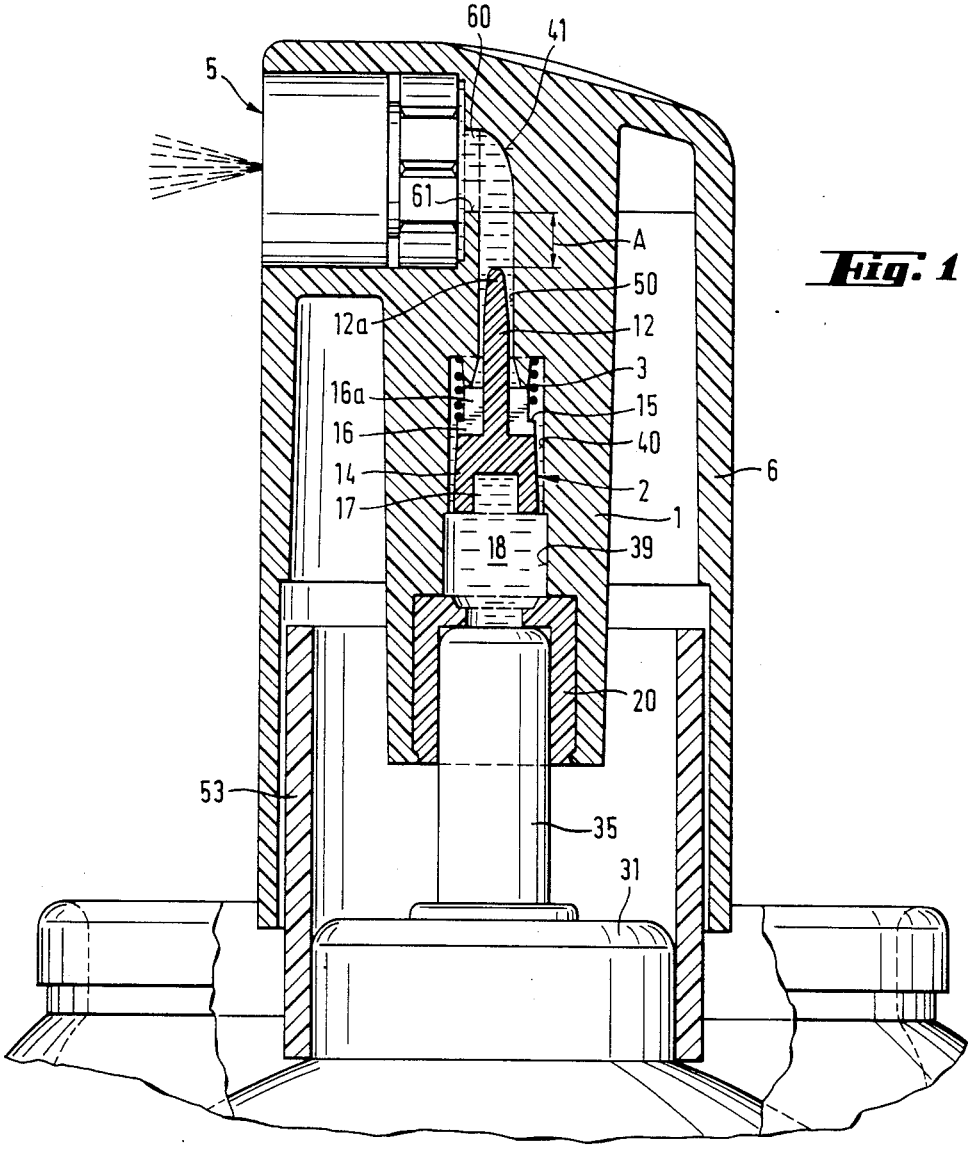
FIG. 1 is a cross-sectional view of a first embodiment of the regulator, regulating the flow rate by means of turbulences, situated on the open valve of an aerosol can in a target provided with a spray nozzle.

With particular reference to FIG. 1, the tappet 6 is provided with a case 1 which has an opening and a discharge channel with a large diameter 39, a diameter 40 and a small diameter 50 which ends in a channel 60 to supply a spray nozzle 5. In the case 1 there is a differential piston 2, the lower side of which has a large diameter 14 with the chamber 17 which serves as supporting point for the column of the medium 18, while its upper side has a small diameter 12 and an end 12a with an aerodynamic shape to reduce turbulences. Between the upper edge 61 of channel 60 and the end 12a of the piston 2 there is a distance "A". The distance "A" between the lower end 12 of the piston 2 and the upper edge 61 of the supply channel 60 of the spray nozzle is at least 150 percent larger than the small diameter 50 in the case 1. The lower end 12 of the piston 2 has an aerodynamic shape to reduce turbulences and the spring 3 is at least as long as the part of the case 1 with the middle sized diameter 40. This distance "A" has to be large enough so that the tubulences building up around the end 12a despite its aerodynamic shape, because it is too near channel 60, can agglomerate in order to form a laminar flow before reaching the upper edge 61 of the channel 60. Moreover, the small diameter 50 in the case 1 has in front of the entrance of the channel 60 a curved all 41, designed to eliminate the formation of further turbulences at the angles, and, on the contrary, to facilitate the streaming of the laminar flow towards the spray nozzle 5. The piston 2 is provided with supporting surface 15 for the spring 3 and the grooves 16 and 16a through which the medium 18 flows even if the spring 3 is totally compressed, thus forming a tight wall. The supporting surface 15 serves also as a limit for the end position of the piston 2 when the latter is moved in an upward direction by highest ejection pressure acting on the medium 18. The more the ejection pressure drops the more the spring 3 expands and pushes the piston 2 in a downward direction until its movement is limited by the clamping sleeve 20 which adapts itself to the piston 35 of an aerosol valve, which is not shown, in the interior of the clamp 31. The clamp 31 bears on its circumference the shaft 53 which serves as axial guide for the tappet 6 in order to prevent it from tilting too far. A certain tilting is inevitable because of the length of the tappet, the only supporting point of which is the piston 35, which can hardly be guided for technical reasons and, therefore, tends to cause an undesirable tilting. It would also be possible to limit this tilting by means of a skirt connected with the sleeve 20 and covering the clamp 31.

When the tappet 6 is actuated and the medium 18 is thus ejected at the highest pressure, namely the filling pressure, the piston 2 is not only moved in an upward direction by the thrust of the medium 18 but also due to suction developing at the entrance of the channel 60 through the expansion of the pressurized medium, and also due to a turbulence acting on the medium 18 so that the spring 3 is exclusively weighted by the pressure of the medium 18 and not additionally by this suction force. At the beginning of the regulation process the spring is too weak as to overcome these two added forces and the piston 2 rests stationary instead of moving in an upward direction. As soon as the ejection pressure drops through a certain discharge of the medium 18, the spring pushes the piston 2 immediately into its regulating position which then corresponds to the remaining pressure. Therefore it is necessary to use a differential spring which develops a larger force during a first expansion process than during the remainder of this process in order to achieve a continuous movement of the piston 2 right from the start.

Figure 2:
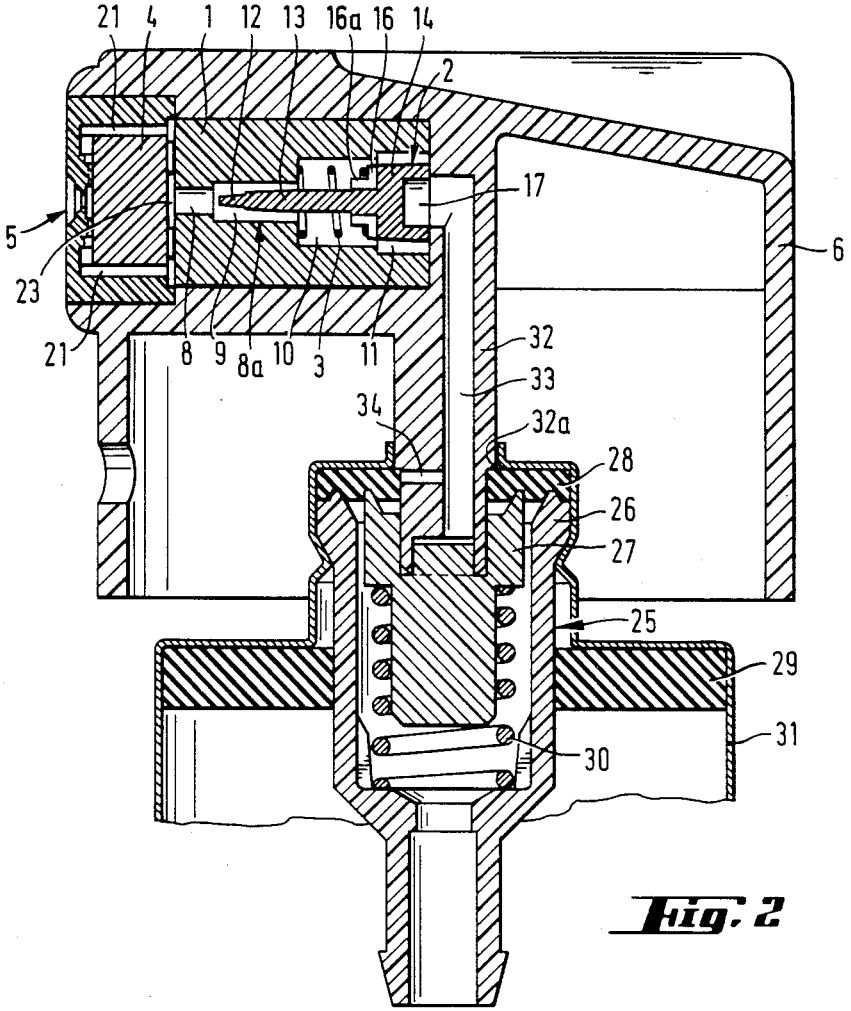
FIG. 2 is a cross-sectional view of a second embodiment of the regulator, regulating the flow rate by means of turbulences, situated on the closed valve of an aerosol can in a tappet provided with a spray nozzle.

FIG. 2 shows a second embodiment of the device according to the invention within a tappet 6, which serves as an opening element of the valve 25, which consists of the valve body 26, the seat 27, the inner seal 28, the outer seal 29, the spring 30 and the clamp 31. A submersible tube is not shown. The tappet 6 has a rod 32, which is provided with the duct 33, running parallel to the axis of the rod 32, and the duct 34, running in a right angle to the duct 33. The rod 32 is inserted in the seat 26 of the valve 25 in such a way that the seat 26 occludes the entrance of duct 33. The duct 34 is arranged in such a way that its entrance is in the upper part of the seal 28. This arrangement of ducts 33 and 34 is necessary because no proven commercially available aerosol valve is immediately tight at the closure of the valve after use. When a soluble gas like FREON is used as a propellant, evaporation occurs practically immediately and there is no leakage of the medium after the closure of the valve 25. If, however, a pressure gas like air or nitrogen is used as a propellant, as it is proposed for the device according to the invention, the ejected medium does not contain any factor which, through its expansive power when getting into contact with the air pressure, causes immediate evaporation of the medium, so that the latter still leaks after the closure of the valve and at the level of the spray nozzle 5 the leakage may continue up to twenty seconds after closure of the valve. This leakage is eliminated by the arrangement of the ducts 33 and 34 of the tappet 6. However, this is not because the valve 25 had become tight, but the entrance of the duct 34 is simply placed in the seal 28 and thus obturated prevents the medium still flowing out of the seat 26 from entering into the duct 34, since the duct 33 is obturated by the seal 28 as described above.

This arrangement is an absolute necessity in cases where the object of the invention is the atomization of media, from which too large an amount leaking at the spray nozzle might occlude the nozzle when the media dries up.

The openings between the lower duct 8 and the small diameter 12 of the piston 2 is 2.0 to 0.12 $mm^2$ for the regulation of the flow of products with a viscosity higher than 10 centipoise and 0.12 to 0.06 $mm^2$ for the regulation of the flow of products with a viscosity lower than 10 centipoise when the piston 2 is entirely located in the lower duct 8.

Figure 3:
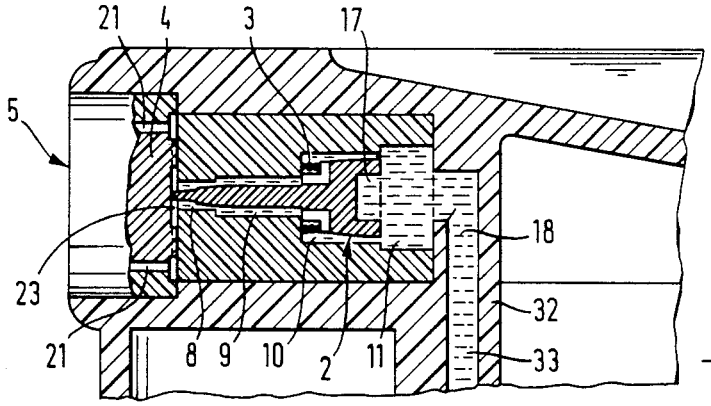
FIG. 3 shows the regulator of FIG. 2 in the case where the valve is open.

FIG. 2 shows a second embodiment of the object of the invention in the rest position, when the spring 3 has shifted the piston 2 to its initial position, whereas FIG. 3 shows the position of the piston 2 during use, at the moment when the valve not shown is open and the medium 18 is being ejected at the highest pressure from the container which is also not shown.

Figure 4:
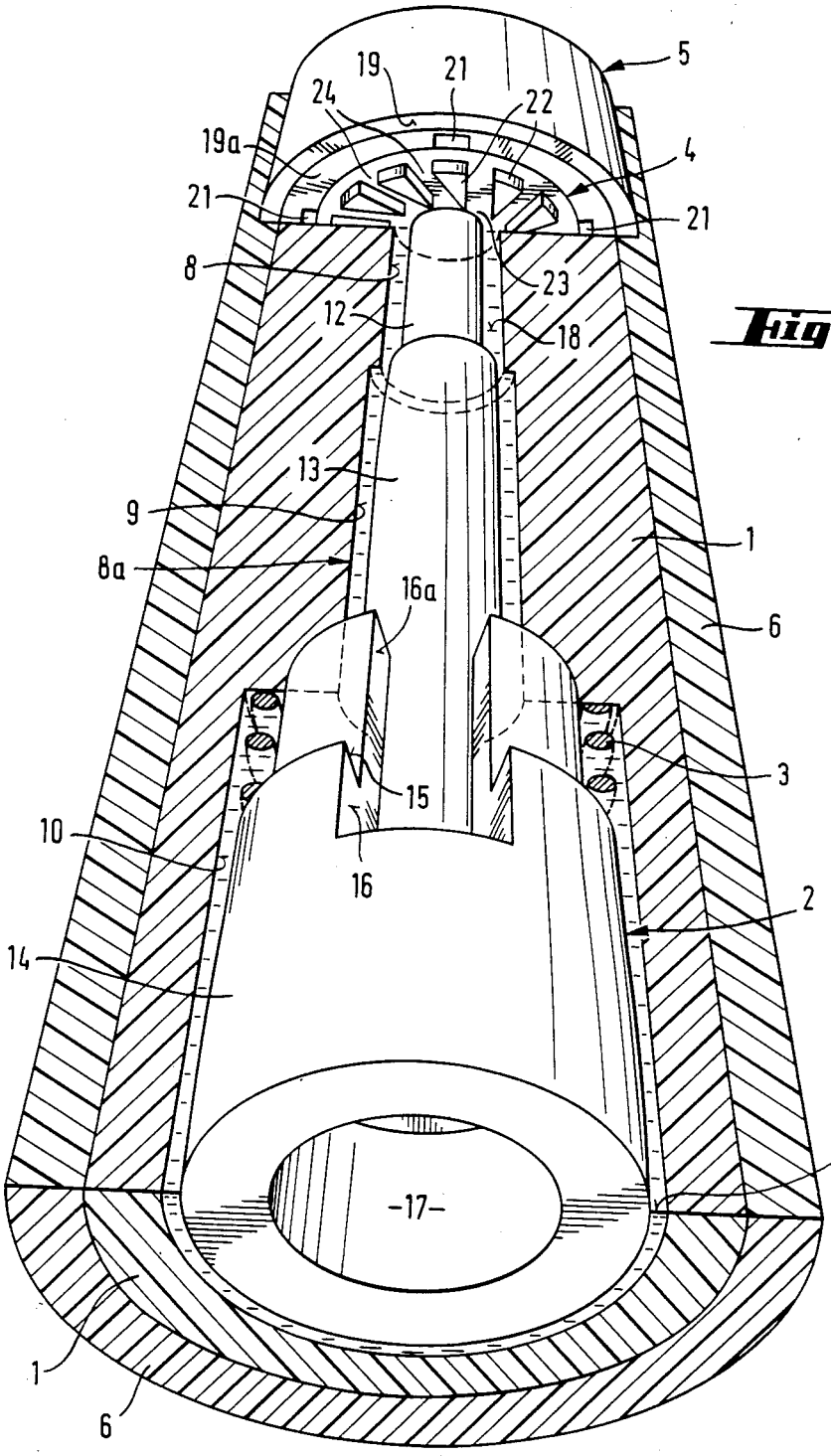
FIG. 4 is a perspective view, partly in cross-section, of a detail of the regulator and the spray nozzle according to FIG. 2.
Figure 5:
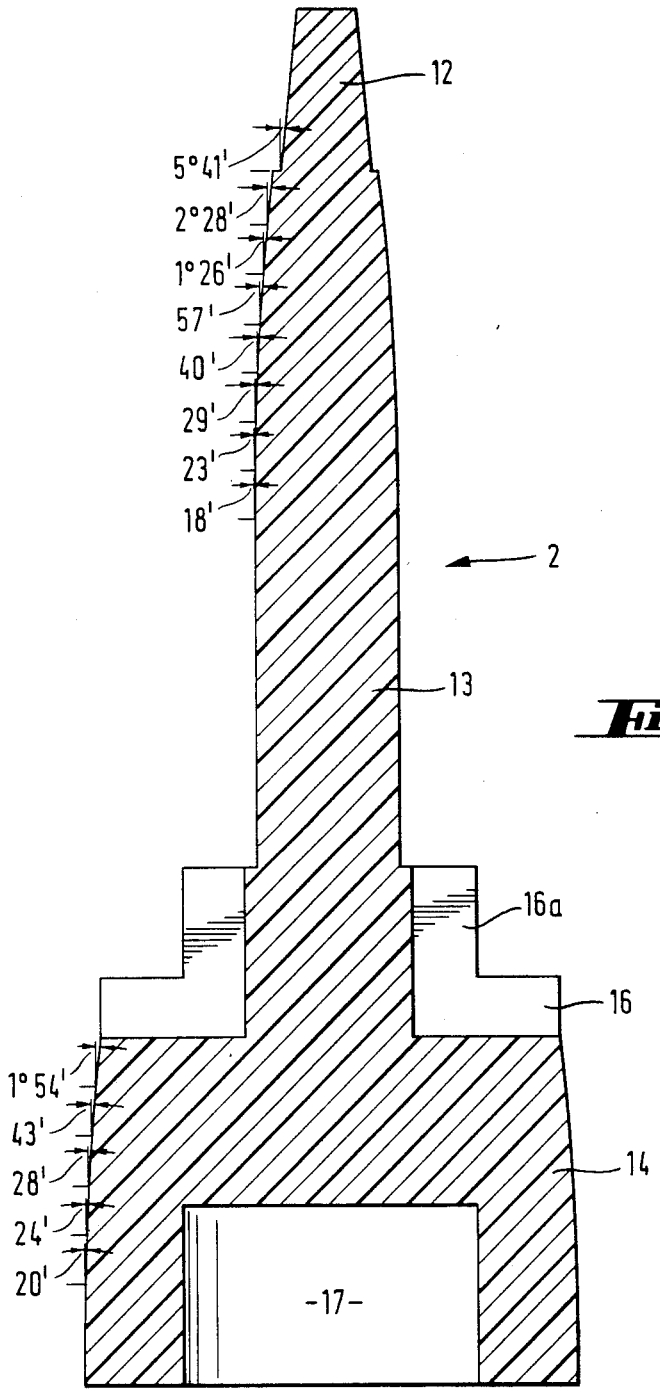
FIG. 5 shows the piston as it is used in the embodiments of the regulator according to FIGS. 1 and 2.

As shown in FIG. 4, the cross-section of the annular channel 19*a* equals 50 percent of the total cross-sections of the tangential channels 24.

Regulatios of the thrust is explained with the help of FIGS. 2, 3 and 4 and works as follows: As soon as the valve 25 opens, the medium 18 enters into the chamber 17 of the piston 2 on the one hand and flows alongside the piston 2 into the discharge channel 8*a* on the other hand. Under the pressure of the medium 18 the piston 2 is pushed towards the spray nozzle 5 and compresses the spring 3. The front side of the piston 2 is firmly pressed against the center of the core 4 and is now in the chamber 23 decreasing the volume of the latter. Since the protrusions 22 of the core 4 up to the edge 19 of the spray nozzle are in close contact with the cylinder 1, the pressurized medium 18 can only get to the spray nozzle 5 by way of the groove-like ducts 24. Since these are arranged in a right angle to the channel 8*a* of the cylinder 1, turbulences occur at the ends of grooves 24, these turbulences having an occluding effect due to the right angled change of the flowing direction. Because of the fact that the grooves 24 run tangentially to the chamber 23, the flow of the medium 18, although tubulent, is subjected to a circular flowing direction, continued through the circular edge 19 which transforms the turbulent flow into a laminar flow which, eventually, is led to the spray nozzle 5 through the channels 21. Due to the fact that the turbulences are transformed into a laminar flow, it constitutes a braking power only, which is all the more stronger the higher the medium's pressure is, but still without reaching such a degree of power as to block to flow.

The braking of the flow of the medium 18 by the turbulences is in this embodiment of the regulator part of the regulation of the flow rate per unit time. The spring 3 does not immediately become effective, but only becomes effective as soon as the thrust of the medium 18 is decreased to such an extent, that the spring 3 can extend and open up the passages at all levels of bearings of the piston 2.

Practical experiments have shown that at the moment of the opening of the valve 25 the product 18 being released at the spray nozzle 5 is not yet atomized, but is ejected in the form of several large sized droplets. This is due to the fact that the medium 18 is not yet ejected by the entire force of the available pressure, because the valve 25 does not open up immediately.

In order to eliminate this phenomenon the rod 32 of the tappet 6 has a large diameter 32*a* by which it is pressed against the seal 28, the duct 34 being located directly below the diameter 32*a*. The duct 34 does not have a circular but a square cross-section. When the tappet 6 is moved downwards in order to open the valve 25, the square duct therefore remains closed for a longer period of time by means of the seal 28 than is the case for a circular duct. A circular duct has to have for an equally large cross-section such a diameter that part of the entrance is already detached from the seal 28. In the case of a circular duct, which has to have for an equally large cross-section such a diameter, that part of the entrance is already detached from the seal 28. Without this detachment the valve 25 is opened sufficiently to release the entire pressure to which the medium 18 is subjected, whereas a square duct 34 with a certain height requires a larger moving space of the tappet 6 on the one hand, so that its opening is detached from the seal 28 and, on the other hand, the duct 34 has instead of a small part of its cross-section serving as an entrance, as in the case of a round duct, the whole cross-section. The cross-section is acording to a predetermined height and serves as entrance of the valve 25 which is reached by the medium 18 through the long way being passed by the tappet 6 in order to open up the entrance of the square duct 34 at the highest available pressures.

Figure 6:
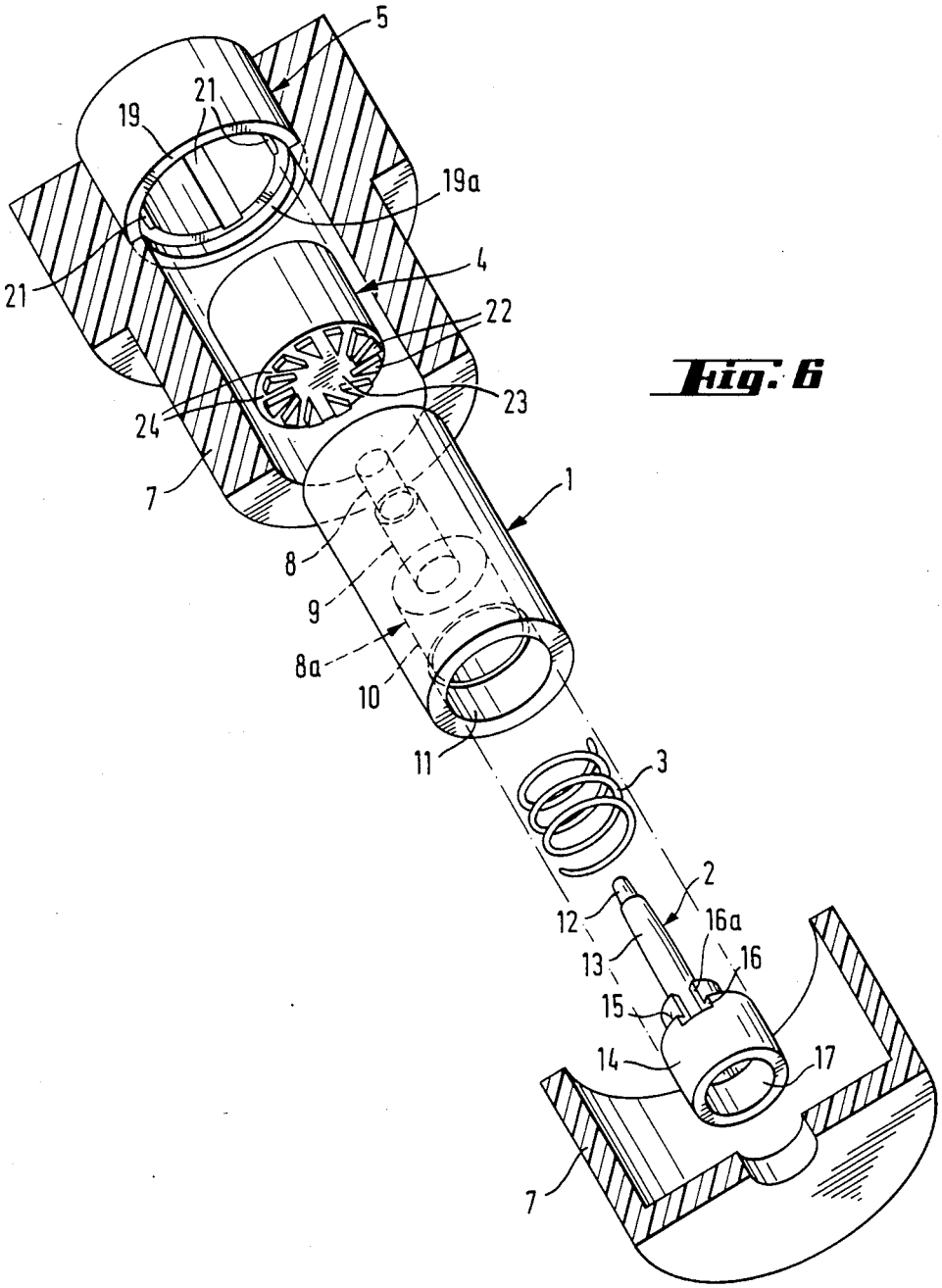
FIG. 6 is a perspective exploded view of a third embodiment of the regulator located in an assembly cylinder with the spray nozzle.

The regulator according to the invention as shown in detail in FIG. 4 consists of the case 1, the differential piston 2, the pressure spring 3 and the core 4 can be made in one piece with the spray nozzle 5, which either are located in a tappet 6 or in an assembly cylinder 7 as illustrated in FIG. 6. The case 1 has the ducts 8, 9, 10 and 11. These ducts form together the discharge channel 8*a*. The piston 2 is subdivided into three parts each of which has a different regulation bearing, i.e., the small diameter 12, the middle sized diameter 13 and the large diameter 14. Moreover, it is provided with the supporting surfce 15, the seat of the spring 3. In order to allow the medium 18 to flow through the different ducts of the case 1 when the spring 3 is totally compressed the piston 2 is provided with grooves 16 and 16*a*. At the level of the large diameter 14 the piston 2 has chamber 17 which serves as a supporting point for the medium

BEST AVAILABLE COPY 18, guaranteeing an effective shifting of the piston 2 by the pressure exerted on the medium 18. The strength of the spring 3 is chosen so that it is totally compressed by the initial presure of 5 bar of a medium 18 in order to enable the piston 2 to press firmly against the core 2 which thus serves as a limit for the end position of the piston 2. The core 4 is inserted in the spray nozzle 5 in such a way that it forms together with the edge 19 of the same a recess 19*a*, from which the supply channels 21 of the spray nozzle 5 are radiating. The upper side of the core 4 bears the protrusions 22, in the center of which there is the chamber 23 from which several grooves 24 are radiating, each of which forms a tangent with the circumference of the chamber 23. The upper side of the protrusion 22 and the edge 19 of the spray nozzle 5 are in such a close contact with the case 1 that the grooves 24 become ducts, which connect the chamber 23 with the recess 19*a*, which thus becomes an annular duct, from which the medium 18 enters the channels 21 of the spray nozzle 5.

The strongest spring 3 is compressed at a certain distance by a maximum pressure of 10.83 bar at an ambient temperature of 20° C.

As best shown in FIG. 6, the lower side of the tapered middle sized diameter 13 of the piston 2 and the entrance of the duct 8 of the discharge channel 8*a* there is maintained an annular space when the piston 2 rests upon the core 4 of the spray nozzle 5, the volume of this space equalling 0.05 per cent of the volume of the intermediary duct 9 minus the volume of the middle sized diameter 12 of the piston 2 located in this duct 9.

Figure 7:
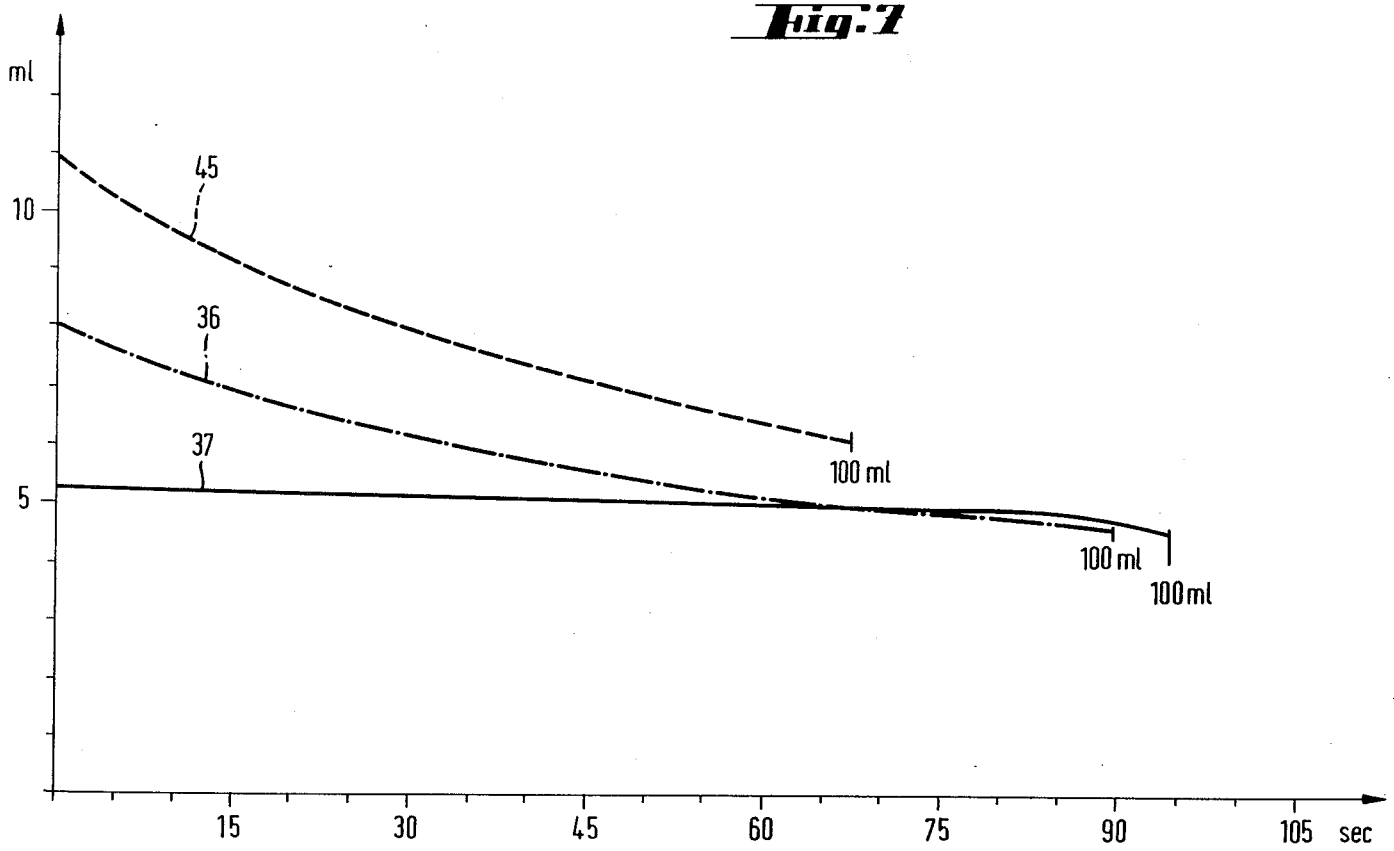
FIG. 7 is a graphical representative which shows the effect of regulating the flow rate per unit time achieved by means of the regulator according to the invention together with the spray nozzle according to U.S. Pat. No. 4,260,110, compared with the flow rates achieved without a regulator.

The regulation of the flow rate by means of a regulator according to the invention is illustrated in FIG. 7. Line 45 indicates the flow rate per unit time when a commercially available spray nozzle is being used. Line 36 shows the flow rate per unit time when the spray nozzle according to U.S. Pat. No. 4,260,110 of the present inventor is being used, and line 37 illustrates the flow rate per unit time achieved by the use of the regulator according to the invention with the spray nozzle mentioned above.

I claim:

1. Thrust control means in combination with a pressurized container from the interior of which product is to be expelled along a flowpath extending through a discharge valve, said thrust control means enable maintaining the amount of product being expelled from the container per unit of time at least substantially constant during the entire emptying time of said container, notwithstanding the reduction of internal pressure occuring during the progressive emptying of the container, said thrust control means comprising:

(a) a casing, (b) a discharge channel in said casing, having a channel axis and a first end connected to said discharge valve and a second end;

(c) a chamber connected to said second end;

(d) a spray nozzle connected to said chamber;

(e) a core in said chamber having radiating channels tangential to and adjacent said second end;

(f) said chamber having supply channels tangential to said radiating channels and adjacent said radiating channels at one end and adjacent said spray nozzle at the other end;

(g) a weighted pressure spring located in the interior of said discharge channel;

(h) a differential piston having a first end and a mid portion engaging said pressure spring and a second larger end disposed closer to said discharge valve than is said first end;

(i) said discharge channel having an inner wall which narrows continuously from said first end to said second end in a stepped configuration permitting space between said differential piston and said inner wall upon compression of said spring to a first end position when the discharge valve is opened, where an opening in said second end decreases to a minimum; and (j) said spring having a given weighted compressive strength for expanding proportionally to a pressure drop due to the discharge of said product from said container and shifts said piston so that said opening of said discharge channel increases gradually until said piston has reached a second end position when a given minimum pressure has been reached in said container.

2. The thrust control means of claim 1, wherein said differential piston engages said core in said first position.

3. The thrust control means of claim 1, wherein said casing includes a tappet, a rod of which is in contact with said discharge valve, a vertical duct in said rod in communication with a square horizontal duct in said rod, said rod having a smaller diameter end portion that rests upon a seal of said discharge valve, and said horizontal duct being disposed at the upper most portion of the smaller diameter portion of the rod.

4. The thrust control means of claim 1, wherein said differential piston is subdivided into a small diameter portion, a tapered middle sized diameter portion and a large diameter portion and a largest part of said tapered middle sized diameter portion is equal to at least 95 percent of an intermediate duct in said second end of said discharge channel.

5. The thrust control means of claim 1, wherein said supply channels have a total cross-sectional area equal to fifty percent of the total cross-sectional area of the tangential radiating channels.

6. The thrust control means of claim 1, wherein said spring is a differential spring.

7. The thrust control means of claim 1, wherein said mid portion of said piston upon which said spring engages is provided with several grooves which are parallel to the axis of said piston and are, surrounded by said spring.

8. The thrust control means of claim 1, wherein a large diameter portion of said second larger end of said piston is biased by the spring in the direction of said valve when the valve is closed.

9. The thrust control means of claim 1, wherein said pressurized container is an aerosol container and said thrust control means is located in the interior of a tappet of said discharge valve.

10. The thrust control means of claim 1, wherein said spray nozzle has an axis and said thrust control means is located upstream and on the axis of said spray nozzle.

11. The thrust control means of claim 1, wherein said discharge channel of said casing has three different diameters, namely a large diameter portion at its first and, a small diameter portion at its second end and a middle sized diameter portion between the small and large diameter portions, said first end of said piston having an aerodynamic shape to reduce turbulences and said spring being at least as long as said middle sized portion of said discharge channel.

12. The thrust control means of claim 11, wherein said mid portion of the piston includes a supporting surface for said spring which serves as a limit for said first end position of said piston.

13. The thrust control means of claim 11, wherein said spring has a length larger than said middle sized diameter portion of said casing.

14. The thrust control means of claim 11, wherein said larger end of said piston has a second chamber.

* * * * *